US005735491A

United States Patent [19]

Atkinson

[11] Patent Number: 5,735,491

[45] Date of Patent: Apr. 7, 1998

[54] METHOD AND APPARATUS FOR DETECTING AN APPROACHING TRAIN BY DETECTING A BRAKE SYSTEM STATUS SIGNAL

[75] Inventor: Denny M. Atkinson, Montpelier, Ind.

[73] Assignee: Michael D. Ray, Montpelier, Ind.

[21] Appl. No.: 728,037

[22] Filed: Oct. 9, 1996

[51] Int. Cl.[6] ..... B61L 15/00

[52] U.S. Cl. ..... 246/124; 246/270 R; 246/167 A; 340/902

[58] Field of Search ..... 246/113, 114 R, 246/114 A, 124, 122 R, 126, 125, 270 R, 273, 293, 408, 167 R, 1 C, 111, 294, 295, 473.1; 340/901, 902, 903, 933, 907, 908

[56] References Cited

U.S. PATENT DOCUMENTS

| | | | |
|---|---|---|---|
| 1,808,022 | 6/1931 | Del Prete . | |
| 1,846,032 | 2/1932 | Hart . | |
| 1,978,286 | 10/1934 | Sommer . | |
| 2,729,805 | 1/1956 | Struke . | |
| 3,233,217 | 2/1966 | Bost . | |
| 3,412,378 | 11/1968 | Thomas . | |
| 3,710,313 | 1/1973 | Kimball et al. . | |
| 3,839,717 | 10/1974 | Paul . | |
| 3,949,300 | 4/1976 | Sadler . | |
| 3,978,447 | 8/1976 | Bankes . | |
| 4,942,395 | 7/1990 | Ferrari et al. | 246/126 |
| 4,952,931 | 8/1990 | Serageldin et al. | 340/901 |
| 5,111,182 | 5/1992 | Ishikawa et al. | 340/903 |
| 5,153,559 | 10/1992 | Atsumi | 340/903 |
| 5,265,831 | 11/1993 | Muller | 246/124 |
| 5,307,060 | 4/1994 | Prevulsky et al. | 340/901 |
| 5,497,148 | 3/1996 | Oliva . | |

*Primary Examiner*—Mark T. Le
*Attorney, Agent, or Firm*—Maginot, Addison & Moore

[57] ABSTRACT

An apparatus for detecting the presence of an approaching train, includes a warning indicator, a receiver for receiving a brake system status signal transmitted from an approaching train, and a relay for coupling a voltage potential to the warning indicator when the brake system status signal is received by the receiver, wherein the warning indicator, the receiver and the relay are positioned within a passenger vehicle. Also there is a method for detecting the presence of an approaching train by detecting a brake system status signal originating from the train.

22 Claims, 3 Drawing Sheets

METHOD AND APPARATUS FOR DETECTING AN APPROACHING TRAIN BY DETECTING A BRAKE SYSTEM STATUS SIGNAL

BACKGROUND OF THE INVENTION

The present invention relates generally to warning devices for passenger vehicles, and in particular to a method and apparatus for detecting the presence of an approaching train.

Every year a large number of accidents occur wherein a passenger vehicle, such as an automobile or a school bus, collides with a train at a railroad crossing. Due to the speeds at which trains generally operate, these accidents are usually horrific in magnitude, and often result in the death of the occupants of the passenger vehicle.

A number of measures have been taken to reduce the number of collisions between passenger vehicles and trains. For example, many railroad crossings have audible warning devices, such as bells. However, the passenger cabins of many modern passenger vehicles are well insulated from external noises and also contain noise generating convenience devices, such as air conditioners or radios. Therefore, it is possible for a driver of the passenger vehicle not to hear the audible warning signals generated at the railroad crossing.

Moreover, a number of railroad crossings contain visual warning devices such as flashing lights which visually warn drivers of an approaching train, and pivotal warning gates which impede movement across a railroad crossing when a train is approaching. However, not all railroad crossings are equipped with such visual warning devices. In particular, many railroad crossings on rural roads are not equipped with visual or audible warning devices since rural roads generally do not support a large amount of vehicular traffic.

Additionally, a number of electronic devices have been developed in an effort to reduce the number of collisions between passenger vehicles and trains. For example, devices have been created which are affixed to a railroad track in order to detect an approaching train. Once an approaching train has been detected, the device transmits a radio-frequency (RF) signal which is received by an RF receiver located in the passenger vehicles operating in the near vicinity of the railroad crossing. The received signal is transformed into a human detectable message, such as a flashing light or a buzzer, which thereby warns the driver of the approaching train. Moreover, a number of devices have been placed on the train itself that transmit an RF signal which is received by a similar RF receiver in the passenger vehicle which transforms the signal to a human detectable message in a similar manner.

However, the above-mentioned electronic safety devices have a number of disadvantages. In particular, these electronic safety devices require that either the railroad track or the train itself be equipped with a dedicated, unique transmitter for generating the RF signal. Moreover, many of these electronic safety devices include receivers which are complex and expensive to manufacture.

What is needed therefore, is an apparatus and method for detecting the presence of an approaching train which utilizes an attribute, such as an existing RF signal associated with the train, without the need for additional or dedicated transmitting equipment.

SUMMARY OF THE INVENTION

In accordance with one embodiment of the present invention, there is provided a method of detecting the presence of an approaching train, including the steps of: (1) receiving a brake system status signal transmitted from the approaching train, the brake system status signal being received by a train warning device positioned in a passenger vehicle; and (2) generating a warning signal in response to receiving the brake system status signal, the warning signal being generated by the train warning device.

In accordance with another embodiment of the present invention, there is provided an apparatus for detecting the presence of an approaching train, including a warning indicator, a receiver for receiving a brake system status signal transmitted from an approaching train, and a relay for coupling a voltage potential to the warning indicator when the brake system status signal is received by the receiver, wherein the warning indicator, the receiver and the relay are positioned within a passenger vehicle.

In accordance with yet another embodiment of the present invention, there is provided a train warning device for detecting the presence of a train including a receiver for receiving a brake system status signal transmitted from an approaching train and a driver alerting circuit coupled to the receiver for generating a warning signal in response to the brake system status signal being received by the receiver, wherein the receiver and the driver alerting circuit are positioned within a passenger vehicle.

It is an object of the present invention to provide a new and useful apparatus for detecting the presence of an approaching train.

It is further the object of the present invention to provide an improved apparatus for detecting the presence of an approaching train.

It is moreover an object of the present invention to provide a new and useful method for detecting the presence of an approaching train.

It is yet another object of the present invention to provide an improved method for detecting the presence of an approaching train.

It is further an object of the present invention to provide an apparatus for detecting the presence of an approaching train which utilizes an existing signal inherent in the operation of the train.

It is moreover an object of the present invention to provide an apparatus for detecting the presence of an approaching train which is relatively simple, constructed of common components, and inexpensive to manufacture.

The above and other objects, features, and advantages of the present invention will become apparent from the following description and the attached drawings.

DETAILED DESCRIPTION OF THE INVENTION

Figure 1:
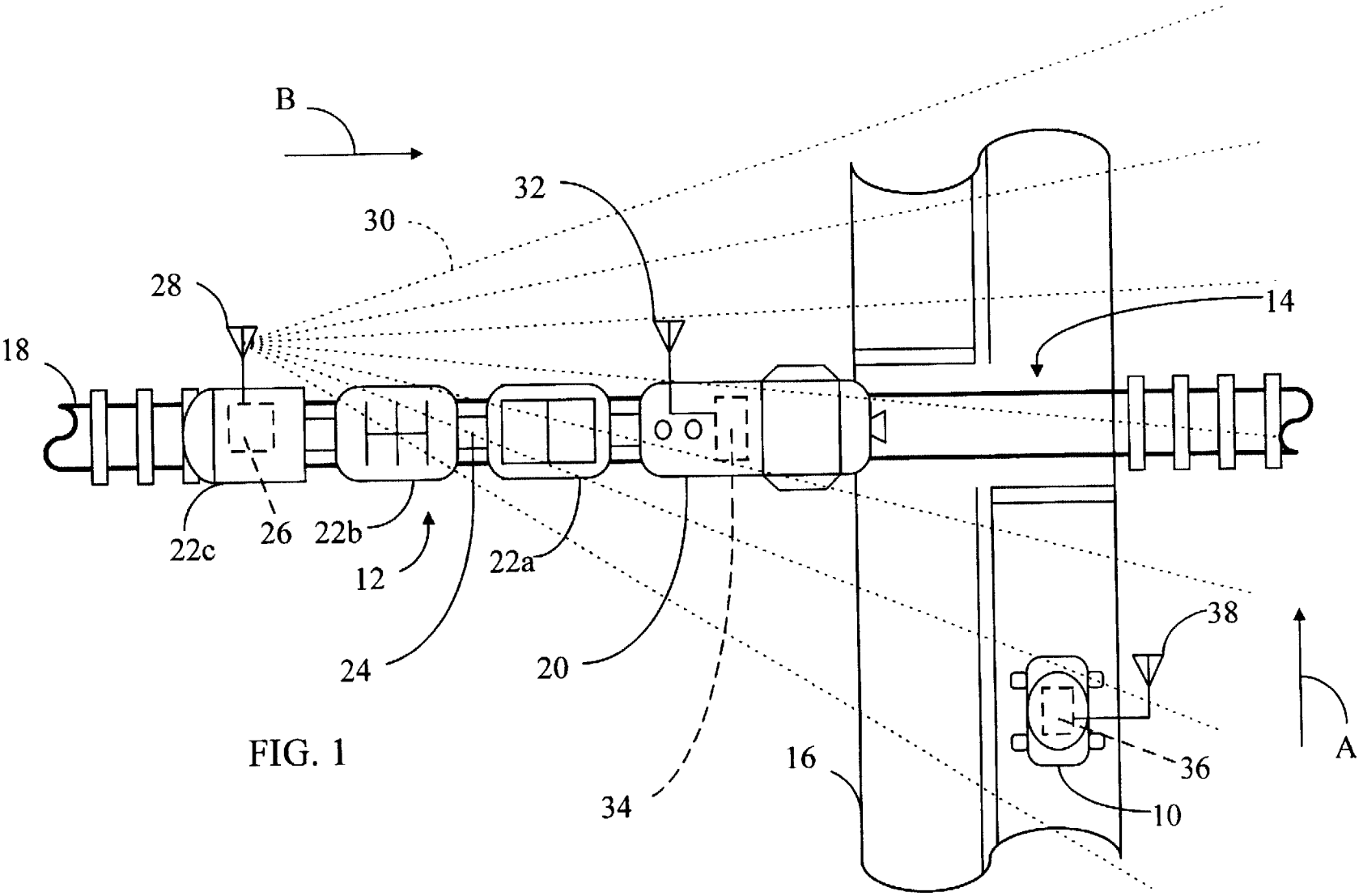
FIG. 1 is a plan view showing a passenger vehicle waiting for an approaching train to pass through a railroad crossing.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIG. 1, there is shown a plan view of a passenger vehicle 10 which is waiting for an approaching train 12 to pass through a railroad crossing 14. The passenger vehicle 10 is traveling on a roadway 16 in the general direction indicated by arrow A, and the train 12 is traveling on a railroad track 18 in the general direction indicated by arrow B. As defined herein, "passenger vehicle" refers to any type of vehicle such as a car, truck, bus, motorcycle, bicycle, etc. other than a train. The train 12 may include one or more engines or locomotives 20 and a plurality of freight cars, tanker cars, etc. **22*a*–22*c* coupled thereto via mechanical couplings 24**.

The train 12 also includes a known braking system (not shown) which is used to slow down and stop the train 12 when necessary. Typical train braking systems are pneumatically operated and include a source of air pressure such as a pump (not shown) which supplies a working gas such as air to braking components (not shown) associated with each of the cars **22*a*–22*c*** via pneumatic couplings (not shown).

It should be appreciated that the integrity of the train braking system is dependent upon the braking system maintaining a predetermined minimum amount of air pressure in the pneumatic couplings and the pneumatic brake lines associated with each of the cars **22*a*–22*c*. In order to verify that a minimum amount of air pressure is in fact maintained by the braking system, the train 12** is typically equipped with a brake pressure monitoring system.

A typical brake pressure monitoring system includes a pressure sensing device (not shown) which is operatively coupled to the braking system and which may be located at a position most remote from the pneumatic air pump. That is, if a pneumatic air pump is positioned at one of the engines 20, the pressure sensing device may be positioned at the car **22*c*. A brake pressure monitoring system may also include a transmitter 26 located proximate the pressure sensing device which intermittently or continuously transmits, via an antenna 28**, a brake system status signal to indicate that a predetermined amount of air pressure is being maintained in the braking system.

The brake system status signal includes a carrier signal 30 which is modulated in a known manner with data or information indicative of the state or status of the braking system. The carrier signal 30 is typically received by an antenna 32 associated with a receiving unit 34 which may be positioned in the one or more engines 20. The receiving unit 34 demodulates the carrier signal 30 in a known manner so as to present the data or information indicative of the state or status of the braking system. In particular, the data or information indicative of the state or status of the braking system may be presented as an audio tone, and/or as a visual indication such as an illumination or flashing of an indicator such as a brake pressure warning lamp. In addition, the data or information may be presented to automatic monitoring equipment such as an on-board computer which continuously monitors the status of the braking system.

Figure 2:
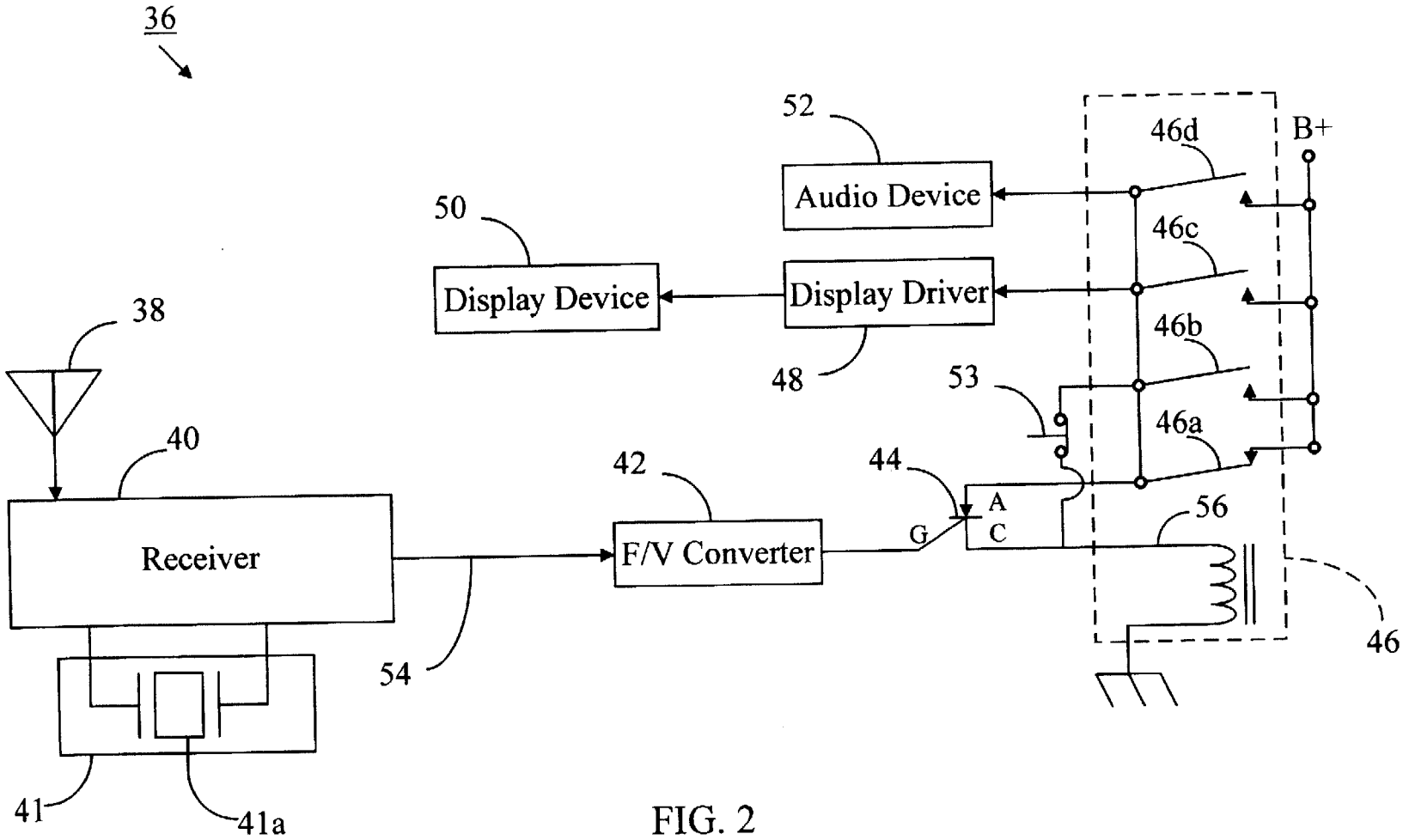
FIG. 2 is a block diagram of a train warning device which is mounted in the passenger vehicle shown in FIG. 1, and which incorporates the features of the present invention therein.

In accordance with the features of the present invention, the passenger vehicle 10 includes a train warning device 36 which also receives, via an antenna 38, the carrier signal 30 that is broadcast from the transmitter 26. Referring now to FIG. 2, there is shown a block diagram of the train warning device 36. The train warning device 36 may include a receiver 40, frequency-to-voltage (F/V) converter 42, switching device 44, relay 46, display driver 48, visual display device 50, audio device 52, and normally-closed reset switch 53. The frequency-to-voltage (F/V) converter 42, switching device 44, relay 46, display driver 48, visual display device 50, audio device 52, and normally-closed reset switch 53 cooperate to define a driver alerting circuit which generates a warning signal in response to an output signal generated by the receiver 40 as described in detail below.

The receiver 40 may be tuned to receive a predetermined carrier frequency such as the carrier signal 30. In particular, a tuning device 41 may be provided which includes one or more crystals **41*a* for tuning the receiver 40 in a known manner so as to receive one or more specific carrier frequencies. For example, the crystals 41*a* may tune the receiver 40 to 161.115 mHz or 457.9375 mHz. Alternatively, the tuning device 41 may include a variable capacitor for tuning the receiver 40 in a known manner so as to receive one or more specific carrier frequencies. The tuning device 41 may be; integrated within the receiver 40 as with a standard AM/FM radio, or may be separate from the receiver 40** as shown in FIG. 2.

The receiver 40 is coupled to the F/V converter 42 via an output line 54. The F/V converter 42 is coupled to the switching device 44. In particular, the switching device 44 may be a silicon controlled rectifier (SCR) having an anode terminal (A), cathode terminal (C) and a gate terminal (G), wherein the gate terminal (G) is coupled to an output of the FN converter 42.

The relay 46 is shown in a de-energized state, and includes a coil portion 56 having a first terminal connected to the cathode terminal (C) of the SCR 44 and a second terminal connected to a system ground potential. The relay 46 also includes a plurality of contacts **46*a*–46*d*. The contact 46*a* is a normally-closed contact, and the contacts 46*b*–46*d*** are normally-open contacts.

The first contact **46*a* couples a voltage potential B+ to the anode terminal (A) of the SCR 44 in a de-energized state of the relay 46. The second contact 46*b* couples the voltage potential B+ to a first terminal of the reset switch 53 in an energized state of the relay 46. A second terminal of the reset switch 53 is coupled to the first terminal of the coil 56 along with the cathode terminal (C) of the SCR 44. When the relay 46 is energized as described further below, the reset switch 53, when depressed, interrupts the voltage potential B+ applied to the coil 56 through contact 46*b*, thus de-energizing the relay 46**.

Figure 3:
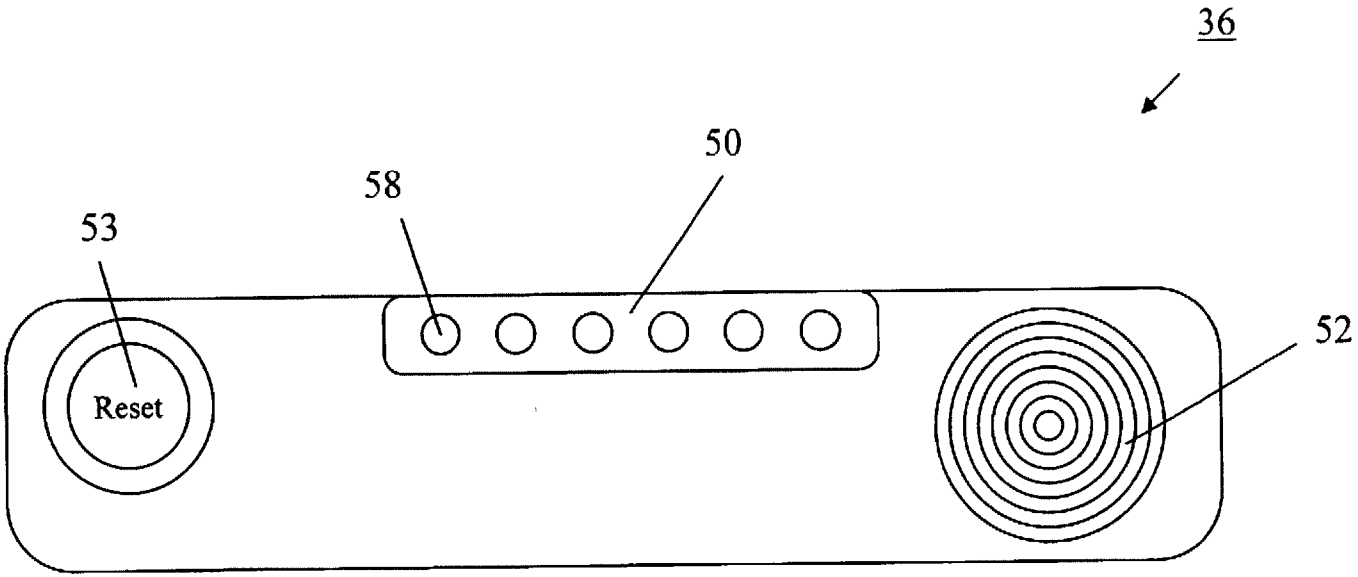
FIG. 3 is a front elevational view of the train warning device shown in FIG. 2.

The third contact **46*c* couples the voltage potential B+ to the display driver 48 in an energized state of the relay 46. The display driver 48 includes circuitry for driving the display device 50. In particular, the display driver 48 may include a conventional multivibrator circuit, logic flip-flops, or 555 timers, etc. which alternatively drive the display device 50 consisting of one or more light-emitting diodes (LEDs) 58 (FIG. 3) on and off. However, it should be appreciated that the display device 50 may include one or more vacuum fluorescent tubes, incandescent bulbs, a liquid-crystal display (LCD) screen, etc. which may be driven by the display driver 48**.

The fourth contact **46*d* couples the voltage potential B+ to the audio device 52 in an energized state of the relay 46. The audio device 52 may include a conventional buzzer (FIG. 3) which, upon application of the voltage potential B+, generates an audible tone that can be detected by the driver of the passenger vehicle 10. However, it should be appreciated that the audio device 52 could be any type of device which is capable of generating an audible warning. For example, the audio device 52** could be a known playback device for playing a prerecorded or synthesized audio warning message.

In operation, a user may position the train warning device 36 in the passenger vehicle 10 in the same manner as positioning a known police radar detector. The voltage potential B+ (typically +6 VDC or +12 VDC) may be applied to the train warning device 36 through a power cord connected to a cigarette lighter or power outlet in the passenger vehicle 10 in a known manner. Alternatively, the train warning device 36 may be "hard wired" into the electrical system of the passenger vehicle 10, or may be battery-operated. The antenna 38 may be integrated into the train warning device 36, or may be positioned outside the passenger vehicle 10 in the same manner as a car radio antenna.

When the passenger vehicle 10 travels on the roadway 16 with power applied to the train warning device 36, and a train 12 approaches the railroad crossing 14, the carrier signal 30 transmitted by the transmitter 26 is received and processed by the receiver 40. In particular, the receiver 40 demodulates the carrier signal 30, and an output signal indicative of the state or status of the braking system is generated on the output line 54.

The output signal from the receiver 40 is converted to a DC voltage by the F/V converter 42. The DC voltage, when applied to the gate terminal (G), triggers the SCR 44 into conduction so as to apply the voltage potential B+ to the first terminal of the coil 56, thereby energizing the relay 46.

When the relay 46 is energized, the first contact **46*a* removes the voltage potential B+ from the anode (A) of the SCR 44, thus driving the SCR 44 into a non-conducting state. The second contact 46*b* applies the voltage potential B+ to the first terminal of the normally-closed reset switch 53 in order to maintain the coil 56 in an energized state. The third contact 46*c* applies the voltage potential B+ to the display driver 48 so as to activate the display device 50 in the manner described above. Likewise, the fourth contact 46*d* applies the voltage potential B+ to the audio device 52** so as to generate an audible warning tone or message in the manner described above.

Once energized, the relay 46 remains energized until the reset button 53 is depressed by the user. That is, the display device 50 and audio device 52 remain activated, until the driver depresses the reset button 53. When depressed, the reset button 53 interrupts the voltage potential B+ applied to the coil 56 thereby de-energizing the relay 46 and removing the voltage potential B+ from the first terminal of the reset button 53, the display driver 48, and the audio device 52. De-energizing the relay 46 also applies the voltage potential B+ to the anode terminal (A) of the SCR 44.

It should be appreciated that the display device 50 and audio device 52 will not be reactivated until a subsequent RF carrier signal 30 is detected again. If the carrier signal 30 is continuously transmitted by the transmitter 26, then the train warning device 36 will continue triggering on the carrier signal 30 until the train 12 is out of the range of the receiver 40.

If the carrier signal 30 is intermittently transmitted by the transmitter 26, then the carrier signal 30 will trigger the train warning device 36 each time that the carrier signal 30 is transmitted while the train 12 is within the range of the receiver 40. Therefore, the display device 50 and audio device 52 may be reactivated by a subsequent transmission from the transmitter 26 only a short period of time after the driver has depressed the reset button 53 in response to the previously detected RF carrier signal 30, thus requiring the driver to again depress the reset button 53.

In sum, what has been described above is an apparatus and method for detecting the presence of an approaching train which utilizes an attribute, such as an existing RF signal, of the train without the need for additional transmitting equipment. What has also been described is an apparatus and method for detecting the presence of an approaching train which utilizes a simple, low-cost receiving unit.

The train warning device 36 operates without the need to retrofit existing trains and/or tracks with additional transmitting devices. By utilizing an existing attribute of the train, i.e. the brake system status signal, both the time and cost of installing dedicated transmitters can be avoided. Moreover, by utilizing a simple design with a relatively small number of inexpensive components, the train warning device 36 is relatively easy and inexpensive to manufacture.

While the invention has been illustrated and described in detail in the drawings and foregoing description, such an illustration and description is to be considered as exemplary and not restrictive in character, it being understood that only the preferred embodiment has been shown and described and that all changes and modifications that come within the spirit of the invention are desired to be protected.

For instance, the receiver 40 may be a frequency modulated (FM) receiver which receives an FM modulated carrier signal 30. The receiver 40 may also be configured so as to receive any type of signal which is transmitted from the brake signal transmitter 26 such as an amplitude modulated (AM), microwave, or laser signal, etc.

The receiver 40 may be configured as a single-chip integrated circuit. The receiver 40 may also be any commonly available radio or scanner which is capable of receiving the carrier signal transmitted by the brake signal transmitter 26.

Further, it should be appreciated that the driver alerting circuit may include other known switching devices. In particular, a circuit with a number of known solid-state switches may be used in place of the relay 46.

The train warning device 36 may be disposed in a number of locations throughout the passenger vehicle 10. For example, the train warning device 36 may have a housing similar to a known police radar detector, and may be mounted on a dashboard or a windshield of the passenger vehicle 10 in a known manner. In addition, the train warning device 36 may be integrated within an electronic device such as an AM/FM car radio so as to utilize common components such as the housing, antenna, audio speakers, and receiver circuitry where applicable.

A timer device may be included in the train warning device 36 so as to temporarily disable the display device 50 and audio device 52 for a predetermined period of time after the reset button 53 has been depressed by the driver. This feature would allow the driver to be warned as to the presence of the train 12, but not subjected to multiple warnings due to the same train 12.

It should also be appreciated that the train warning device of the present invention may be triggered by existing RF signals associated with train maintenance (hereinafter referred to as "train maintenance signals") other than the above-described brake system status signal. Note that a train maintenance signal is generated by a train for the sole purpose of maintaining proper operation of the train.

What is claimed is:

1. A method of detecting the presence of an approaching train, comprising the steps of:

receiving a brake system status signal transmitted from the approaching train, said brake system status signal being received by a train warning device positioned in a passenger vehicle; and generating a warning signal in response to receiving said brake system status signal, said warning signal being generated by said train warning device.

2. The method of claim 1, wherein said warning signal generating step includes the step of:

displaying a visual warning signal in response to receiving said brake system status signal.

3. The method of claim 2, wherein warning signal said generating step further includes the step of:

generating an audio warning signal in response to receiving said brake system status signal.

4. The method of claim 1, wherein said warning signal generating step includes the step of:

generating an audio warning signal in response to receiving said brake system status signal.

5. An apparatus for detecting the presence of an approaching train, comprising:

a warning indicator;

a receiver for receiving a brake system status signal transmitted from an approaching train; and a relay for coupling a voltage potential to said warning indicator when said brake system status signal is received by said receiver, wherein said warning indicator, said receiver and said relay are positioned within a passenger vehicle.

6. The apparatus of claim 5, further comprising a switching device for energizing said relay in response to a trigger signal generated by said receiver.

7. The apparatus of claim 6, further comprising a reset switch for de-coupling said voltage potential from said warning indicator.

8. The apparatus of claim 5, wherein said warning indicator includes a display device for generating a visual warning signal.

9. The apparatus of claim 8, wherein said warning indicator further includes an audio device for generating an audio warning signal.

10. The apparatus of claim 5, wherein said warning indicator includes an audio device for generating an audio warning signal.

11. The apparatus of claim 5, wherein said receiver is an FM receiver.

12. A train warning device for detecting the presence of a train comprising:

a receiver for receiving a brake system status signal transmitted from an approaching train; and a driver alerting circuit coupled to said receiver for generating a warning signal in response to said brake system status signal being received by said receiver, wherein said receiver and said driver alerting circuit are positioned within a passenger vehicle.

13. The train warning device of claim 12, wherein said driver alerting circuit includes a warning indicator and a relay for coupling a voltage potential to said warning indicator when said brake system status signal is received by said receiver.

14. The train warning device of claim 13, wherein said driver alerting circuit further includes a switching device for energizing said relay in response to a trigger signal generated by said receiver.

15. The train warning device of claim 14, wherein said driver alerting circuit further includes a reset switch for de-coupling said voltage potential from said warning indicator.

16. The train warning device of claim 13, wherein said warning indicator includes a display device for generating a visual warning signal.

17. The train warning device of claim 16, wherein said warning indicator further includes an audio device for generating an audio warning signal.

18. The train warning device of claim 13, wherein said warning indicator includes an audio device for generating an audio warning signal.

19. The apparatus of claim 12, wherein said receiver is an FM receiver.

20. A method of detecting the presence of an approaching train, comprising the steps of:

positioning a receiver in a passenger vehicle adapted to travel on a roadway;

receiving a brake system status signal transmitted from the approaching train with the receiver; and generating a warning signal in response to the receiver receiving said brake system status signal.

21. The method of claim 20, wherein the passenger vehicle is a car, truck or bus.

22. A method of detecting the presence of an approaching train, comprising the steps of:

positioning a receiver in a passenger vehicle adapted to travel on a roadway;

receiving a train maintenance signal transmitted from the approaching train with the receiver; and generating a warning signal in response to the receiver receiving said train maintenance signal, wherein the train maintenance signal is a brake system status signal.

* * * * *